US009926183B2

(12) United States Patent
Kim

(10) Patent No.: US 9,926,183 B2
(45) Date of Patent: Mar. 27, 2018

(54) DISPENSER WITH AN INTEGRAL CONTROL SWITCH FOR DISCHARGING WATER AND ICE ON REFRIGERATOR

(71) Applicant: Dongbu Daewoo Electronics Corporation, Seoul (KR)

(72) Inventor: Dong Sun Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 139 days.

(21) Appl. No.: 14/823,933

(22) Filed: Aug. 11, 2015

(65) Prior Publication Data

US 2016/0368755 A1 Dec. 22, 2016

(30) Foreign Application Priority Data

Jun. 16, 2015 (KR) ..... 10-2015-0084860

(51) Int. Cl.

| | |
|---|---|
| ***F25C 5/00*** | (2006.01) |
| ***B67D 1/12*** | (2006.01) |
| ***F25D 23/12*** | (2006.01) |
| *B67D 1/00* | (2006.01) |

(52) U.S. Cl.

CPC ..... *B67D 1/124* (2013.01); *F25C 5/005* (2013.01); *F25D 23/126* (2013.01); *B67D 1/0014* (2013.01)

(58) Field of Classification Search

CPC ..... B67D 1/124; B67D 1/0014; F25C 5/005; F25C 2400/10; F25C 2400/06; F25D 23/126

USPC ..... 222/146.6, 1, 23; 62/389, 344, 398, 340

See application file for complete search history.

(56) References Cited

U.S. PATENT DOCUMENTS

| | | | | |
|---|---|---|---|---|
| 4,800,935 | A * | 1/1989 | Buchser | B67D 1/08 141/362 |
| 8,413,460 | B2 * | 4/2013 | Yang | F25D 23/126 62/389 |
| 9,739,518 | B2 * | 8/2017 | Moon | F25C 5/005 |
| 2010/0319388 | A1 | 12/2010 | Yang et al. | |
| 2011/0083749 | A1 * | 4/2011 | Kim | A47J 31/00 137/2 |
| 2011/0132021 | A1 | 6/2011 | Fulton et al. | |
| 2011/0259719 | A1 * | 10/2011 | Park | F25D 23/126 200/310 |
| 2015/0276293 | A1 * | 10/2015 | Seo | F25D 23/126 222/1 |
| 2015/0300729 | A1 * | 10/2015 | Seo | F25D 23/126 62/126 |

FOREIGN PATENT DOCUMENTS

| | | |
|---|---|---|
| KR | 10-1999-0062189 | 7/1999 |
| KR | 10-2010-0137378 A | 12/2010 |

* cited by examiner

*Primary Examiner* — Charles P Cheyney

(57) ABSTRACT

A refrigerator with a single lever switch for a user to control dispensing both water and ice. A water/ice dispenser includes a main body, an ice discharge port disposed on one side of the main body, an ice guide coupled to the outlet of the ice discharge port, a water discharge port disposed on the other side of the main body, and an integral lever. The integral lever is coupled pivotally to the ice guide through its middle portion. One end of the integral lever serves as a water discharge button for a user to request dispensing water and the other end of the integral lever serves as an ice discharge button for a user to request dispensing ice.

8 Claims, 6 Drawing Sheets

DISPENSER WITH AN INTEGRAL CONTROL SWITCH FOR DISCHARGING WATER AND ICE ON REFRIGERATOR

CROSS REFERENCE

This application claims priority to Korean Patent Application No. 10-2015-0084860, filed on Jun. 16, 2015, the disclosure of which is herein incorporated by reference in its entirety for all purposes.

TECHNICAL FIELD

Embodiments of the present invention relate to refrigerators, and more particularly relate to ice and water dispensing mechanisms on refrigerators.

BACKGROUND

Refrigeration equipments (e.g., refrigerator) provide storage spaces maintained at low temperatures, such as for food. For example, a refrigerator may include a refrigerating compartment maintained at a temperature above zero but below room temperature, and a freezing compartment maintained at a temperature below zero.

Recently, with the increase of demand for generating and supplying purified water and ice at home, it is increasingly desirable for a refrigeration equipment to have a water purifier and an ice maker. For example, an ice maker may be installed in the freezing compartment, the refrigerating compartment, or the door, depending on the product design of the refrigeration equipment.

Typically, in a refrigeration equipment having a water purifier and an ice maker that are formed integrally with each other, a dispenser is installed on the exterior side of the front door of the refrigeration equipment for dispensing water and/or ice.

FIG. 1 is a side cross-sectional view of a conventional dispenser used in refrigeration equipment.

Referring to FIG. 1. The main body 102 of a dispenser is installed on the exterior side of the front door and includes a cavity directing to the inside of the door. In this cavity, an ice discharge port 104, an ice guide 106, a water discharge port 108, a water discharge lever 110, and an ice discharge lever 112 may be installed.

More specifically, the ice discharge port 104 may be disposed on one side (e.g., inside the cavity) of the main body 102 of the dispenser. The ice guide 106 may be coupled to the end of the ice discharge port 104. The water discharge port 108 may be formed on the other side (e.g., outside the cavity) of the main body 102.

On one side (e.g., outward side) of the ice guide 106, the water discharge lever 110 having a switch (not shown) on the back side thereof may be installed. By pressing the water discharge lever 110, a user may dispense water through the water discharge port 108.

Similarly, on the inner wall surface of the cavity, the ice discharge lever 112 having a switch (not shown) on the back side thereof may be installed. By pressing the ice discharge lever 112, the user may dispense ice through the ice guide 106.

Because such a dispenser is equipped with two separate levers for discharging water and ice respectively, the assembly of the dispenser is unfortunately complex and contribute to significant manufacturing and material cost.

SUMMARY

In view of above, the present invention provides a dispenser configuration for refrigeration equipment, an apparatus and a method for controlling operation thereof that offers simple assembly in manufacture and easy user control.

Exemplary embodiments of the present disclosure provide a water/ice dispenser on a refrigeration equipment. The dispenser includes a main body; an ice discharge port disposed at one side of the main body of the dispenser, the ice discharge port being opened or closed for discharging or stopping discharging ice; an ice guide coupled to the tip of the ice discharge port; a water discharge port disposed at the other side of the main body of the dispenser, the water discharge port being opened or closed for discharging or stopping discharging water; and an integral lever coupled pivotally to the ice guide through an intermediate end, one end of the integral lever acting as a water discharge button for selectively discharging water and the other end of the integral lever acting as an ice discharge button for selectively discharging ice.

The integral lever may be pivotally hinge-coupled to one end of the lower portion of the ice guide and can pivot in the vertical direction.

The apparatus for controlling operation of a dispenser for refrigeration equipment may further include a first switch configured to generate a sensing signal for opening of the water discharge port when a pressing (e.g., by a user) of the water discharge button is sensed; and a second switch configured to generate a sensing signal for opening of the ice discharge port when a pressing (e.g., by a user) of the ice discharge button is sensed.

The apparatus for controlling operation of a dispenser for refrigeration equipment may further include a first restoring member configured to restore automatically the position of the integral lever to the original position prior to the pressing of the water discharge button when the pressing is released; and a second restoring member configured to restore automatically the position of the integral lever to the original position prior to the pressing of the ice discharge button when the pressing is released.

The first and second restoring members may include a spring structure.

Exemplary embodiments of the present disclosure also provide an apparatus for controlling operation of a dispenser for refrigeration equipment, including a main body of the dispenser; an ice discharge port disposed at one side of the main body of the dispenser, the ice discharge port being opened or closed for discharging or stopping discharging ice; an ice guide coupled to the tip of the ice discharge port; a water discharge port disposed at the other side of the main body of the dispenser, the water discharge port being opened or closed for discharging or stopping discharging water; an integral lever coupled pivotally to the ice guide through an intermediate end, one end of the integral lever acting as a water discharge button for selectively discharging water and the other end of the integral lever acting as an ice discharge button for selectively discharging ice; when a pressing of the water discharge button is sensed, a water discharge sensing element configured to generate a corresponding sensing signal of water discharge; when a pressing of the ice discharge button is sensed, an ice discharge sensing element configured to generate a corresponding sensing signal of ice discharge; and a control unit configured to control opening of the water discharge port according to the sensing signal of water discharge, and control opening of the ice discharge port according to the sensing signal of ice discharge.

The water discharge sensing element may include a switch configured to generate the sensing signal of water discharge when the pressing of the water discharge button is sensed; and a restoring member configured to restore automatically the position of the integral lever to the original position prior to the pressing of the water discharge button when the pressing is released.

The restoring member may be a spring structure installed at the back side of the water discharge button.

The ice discharge sensing element may include a switch which configured to generate the sensing signal of ice discharge when the pressing of the ice discharge button is sensed; and a restoring member configured to restore automatically the position of the integral lever to the original position prior to the pressing of the ice discharge button when the pressing is released.

The restoring member may be a spring structure installed at the back side of the ice discharge button.

Further exemplary embodiments of the present disclosure provide a method for controlling operation of a dispenser for refrigeration equipment, including monitoring pressing a water discharge button or pressing an ice discharge button, wherein the water discharge button is one end of an integral lever coupled pivotally to an ice guide assembled at the tip of an ice discharge port of a main body of the dispenser, and the ice discharge button is the other end of the integral lever; discharging water by opening a water discharge port disposed at the other side of the main body of the dispenser, when the pressing of the one end is sensed; discharging ice by opening the ice discharge port, when the pressing of the other end is sensed; and restoring automatically the position of the integral lever to the original position prior to the pressing of the one end or the other end when the pressing is released.

The discharging water may include discharging the water while the one end is pressed; and stopping discharging the water when the pressing of the one end is released.

The discharging ice may include discharging the ice while the other end is pressed; and stopping discharging the ice when the pressing of the other end is released.

According to the present invention, by structuring a water discharge lever and an ice discharge lever as an integral lever, water or ice is allowed to be discharged with a mode of pivotal movement of the integral lever in the vertical direction, and thereby it is possible to realize a simplification of a dispenser structure and an easiness of assembly. In addition, it is also possible to reduce a processing cost and a material cost of the dispenser structure through a reduction in the number of components.

The foregoing is a summary and thus contains, by necessity, simplifications, generalizations and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

Embodiments of the present invention will be better understood from a reading of the following detailed description, taken in conjunction with the accompanying drawing figures in which like reference characters designate like elements and in which.

DETAILED DESCRIPTION

Figure 1:
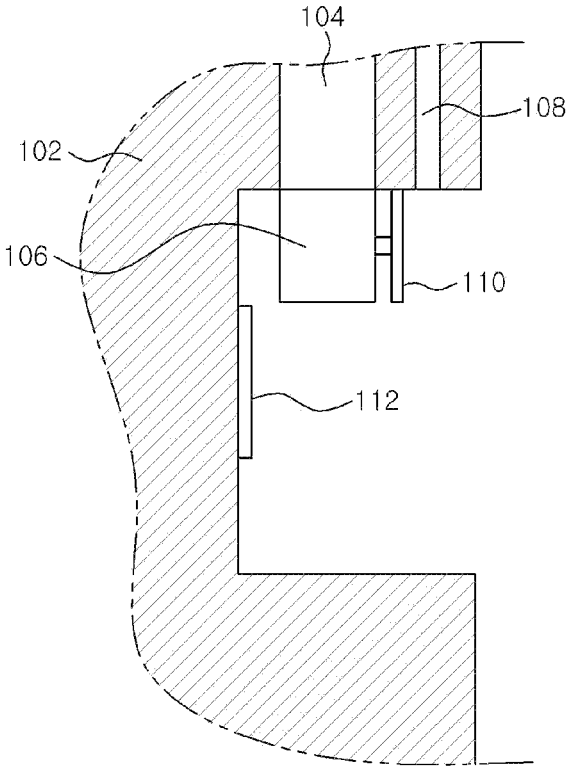
FIG. 1 (PRIOR ART)
FIG. 1 is a side cross-sectional view of a conventional water/ice dispenser in refrigeration equipment.

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

NOTATION AND NOMENCLATURE

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing" or "accessing" or "executing" or "storing" or "rendering" or the like, refer to the action and processes of a computer system, or similar electronic computing device, that manipulates and transforms data represented as physical (electronic) quantities within the computer system's registers and memories and other computer readable media into other data similarly represented as physical quantities within the computer system memories or registers or other such information storage, transmission or display devices. When a component appears in several embodiments, the use of the same reference numeral signifies that the component is the same component as illustrated in the original embodiment.

Figure 2:
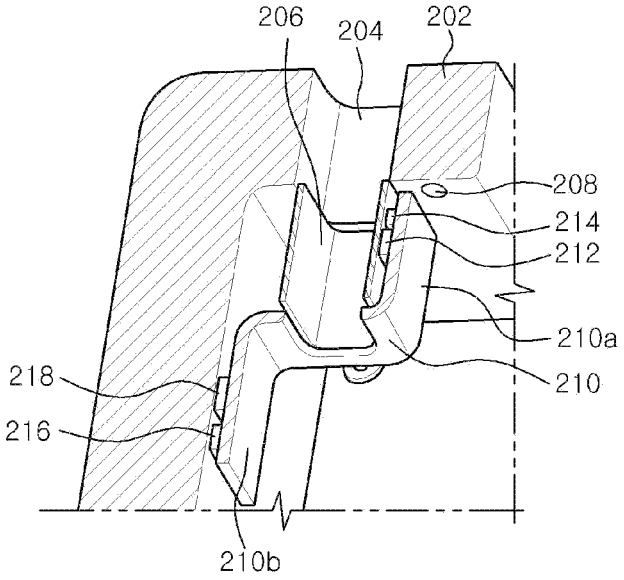
FIG. 2 is a side cross-sectional view of an exemplary water/ice dispenser configuration used in a refrigeration equipment in accordance with an embodiment of the present disclosure.
Figure 3:
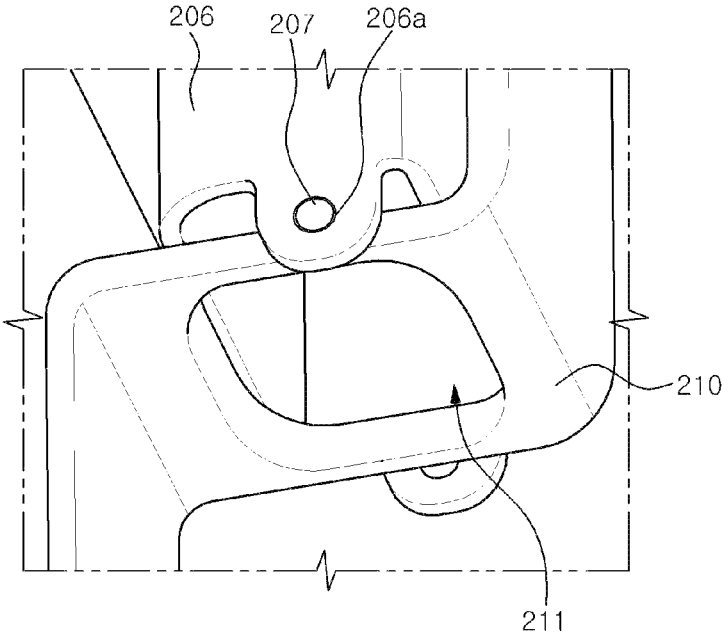
FIG. 3 is a partially enlarged view of FIG. 2 showing a configuration in which an integral lever is hinge coupled through a shaft in accordance with an embodiment of the present disclosure.
Figure 4:
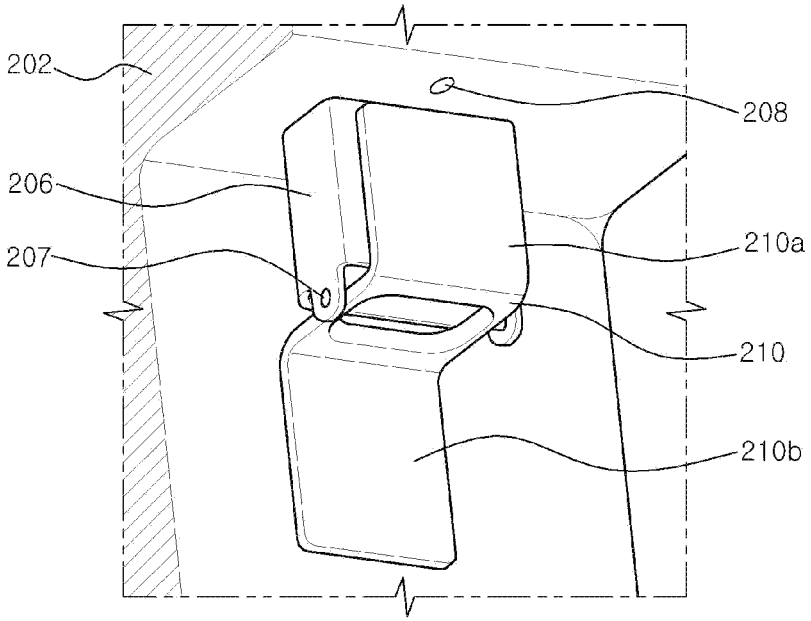
FIG. 4 is a configuration of an exemplary dispenser structure for refrigeration equipment in accordance with an embodiment of the present disclosure.

Dispenser with an Integral Control Switch for Discharging Water and Ice on Refrigerator FIG. 2 illustrates a side cross-sectional view of the configuration of an exemplary dispenser installed on a refrigeration equipment in accordance with an embodiment of the present disclosure. FIG. 3 illustrates an exemplary dispenser structure with an integral lever hingedly coupled through a shaft in accordance with an embodiment of the present disclosure. FIG. 4 illustrates a structural view of the exemplary dispenser for refrigeration equipment in accordance with an embodiment of the present disclosure.

Referring FIG. 2, a dispenser is installed on the exterior side of the front door of the refrigeration equipment (not explicitly shown). The dispenser is operable to dispense water from a water purifier and ice from an ice maker in the refrigeration equipment, e.g., when the front door is closed. A cavity is formed in the main body 202 of the dispenser and directs to the inner side of the door. In the cavity, an ice discharge port 204, an ice guide 206, a water discharge port 208, an integral lever 210, a first and a second switches 212, 216, a first and a second restoring members 214, 218 may be installed. An ice maker may, for example, be disposed on the inner side of a door of the refrigeration equipment.

The ice discharge port 204 is disposed on one side (e.g., inside the cavity) of the main body 202 and is capable of discharging ice produced in the refrigeration equipment to the outside. The ice discharge port 204 may include the ice guide 206 installed at the tip (or the end) which is a protruding member that extends from the main body of the ice guide 206.

The water discharge port 208 may be installed on the other side (e.g., outside the cavity) of the main body 202 for discharging water from the water purifier that is disposed inside the refrigeration equipment (not shown).

As shown in FIGS. 3 and 4, an assembling hole 206*a* may be formed at the lower end of the ice guide 206 which is rounded and protrudes downward in this example. A shaft 207 is inserted into the assembling hole 206*a* for hingedly couple the integral lever 210 to the ice guide 206. In this example, a middle portion of the integral lever 210 is hingedly coupled with the assembling hole 206*a* of the ice guide 206 so it can pivot vertically. In FIG. 3, reference numeral 211 represents a through hole on the integral lever 210 for ice to fall through when it comes from the ice guide 206.

In this embodiment, one end (e.g., the upper end) of the integral lever 210 can pivot in the vertical direction through the hinge coupling and is configured as a water discharge button 210*a* for discharging water. The other end (e.g., the lower end) is configured as an ice discharge button 210*b* for discharging ice.

The water discharge button 210*a* includes the first switch 212 and the first restoring member 214 that are disposed on the back side of the ice guide 206. The first switch 212 can detect an external pressure applied thereto (e.g., by a user) and generate a signal instructing to open the water discharge port 208. The first restoring member 214 can automatically restore the integral lever 210 to the relaxed state when the external pressure is released. For instance, the first restoring member 214 may include a spring structure.

Similarly, the ice discharge button 210*b* includes the second switch 216 and the second restoring member 218 disposed on the back side of the wall surface inside the cavity. The second switch 216 can detect an external pressure applied thereto (e.g., by a user) and generate a signal instructing to open the ice discharge port 204. The second restoring member 218 restores automatically the position of the integral lever 210 to the relaxed state when the external pressure is released. The second restoring member 218 may be, for example, a spring structure.

Herein, the first switch 212 and the first restoring member 214 may be collective referred to as a water discharge sensing element; and the second switch 216 and the second restoring member 218 may be collectively referred to as an ice discharge sensing element.

In this example, the integral lever 210 interlocks with the first and second switches 212, 216. The first and second restoring members 214, 218 may be coupled to the main body 202 of the dispenser. For instance, the assembly process can be as follows.

(1) Providing the main body 202 of the dispenser having the ice discharge port 204 and the water discharge port 208 formed therein;

(2) Assembling the ice guide 206 at the end (tip portion) of the ice discharge port 204;

(3) Assembling the switch and the spring structure to the predetermined location of one side of the ice guide 206 and to the predetermined location of one side of the main body 202 of the dispenser respectively; and (4) Coupling the integral lever 210 to the protruding lower end of the ice guide 206 by using a hinge.

As a result, when a user presses the water discharge button 210*a* interlocked with the first switch 212 disposed on the back side of one end of the integral lever 210, water can be discharged to the outside of the refrigeration equipment through the water discharge port 208. Upon the user releasing the water discharge button 210*a*, the position of the integral lever 210 is restored automatically to the original position by the first restoring member 214, and then water dispensing is stopped.

Similarly, upon a user pressing the ice discharge button 210*b* interlocked with the second switch 216 disposed on the back side of the other end of the integral lever 210, the user may dispense ice from the refrigeration equipment through the ice discharge port 204 and the ice guide 206. When the user releases the ice discharge button 210*b*, the position of the integral lever 210 is restored automatically to the original position by the second restoring member 218. At the same time, ice discharging from the ice discharge port 204 is stopped.

Figure 5:
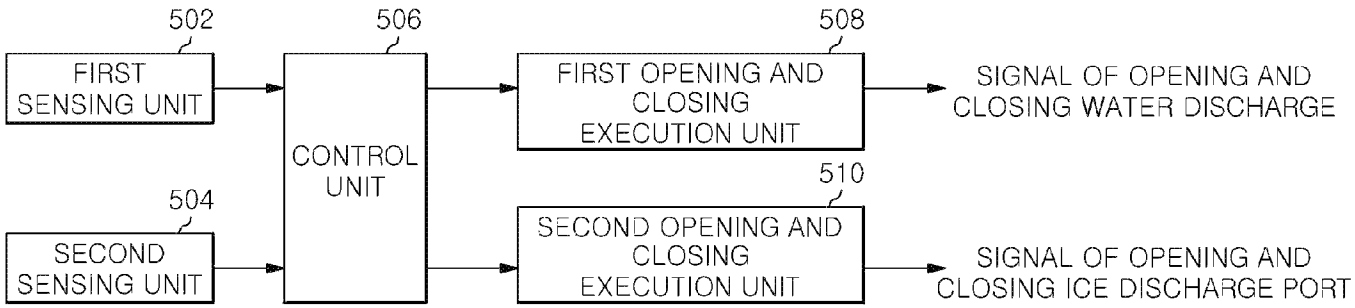
FIG. 5 is a block diagram of circuitry for controlling an exemplary dispenser on the refrigeration equipment in accordance with an embodiment of the present disclosure.

FIG. 5 is a block diagram of circuitry coupled to an exemplary dispenser on a refrigeration equipment in accordance an embodiment of the present disclosure. The circuitry may include a first sensing unit 502, a second sensing unit 504, a first opening and closing execution unit 508, and a second opening and closing execution unit 510.

Referring to FIG. 5, the first sensing unit 502 may correspond to, for example, the first switch 212 shown in FIG. 2, and operate to send a signal to the control unit 506 upon receiving a user instruction for dispensing water. Based on the signal, the control unit 506 controls the water discharge port 208 to open. Similar, when receiving a user instruction to stop dispensing water, the first sensing unit 502 can send a corresponding signal to the control unit 506.

Similarly, the second sensing unit 504 may correspond to, for example, the second switch 216 shown in FIG. 2. Upon receiving a user instruction to dispense ice, the sensing unit 504 may operate to send a signal to the control unit 506 for opening the ice discharge port 204. Upon receiving a user instruction to stop dispensing ice, the second sensing unit 504 sends a corresponding signal to the control unit 506.

The control unit 506 may be, for example, a microprocessor configured to control the operations of the refrigeration equipment. The control unit 506 is capable of generating a command for opening the water discharge port 208 and transmitting the command to the first opening and closing execution unit 508. When the first sensing unit 502 senses a release of the external pressure, the control unit is capable of generating a command for closing the water discharge port 208 and transmitting the command to the first opening and closing execution unit 508.

Similarly, the control unit 506 can receive a sensed pressing signal from the second sensing unit 504 and accordingly generate an opening command to open the ice discharge port 204 and transmits the opening command to the second opening and closing execution unit 510. The control unit can receive a sensed release signal from the second sensing unit 504 and generate a closing command to close the ice discharge port 204 and transmits the closing command to the second opening and closing execution unit 510.

The first opening and closing execution unit 508 may have multiple components, e.g., including a solenoid valve and a driving circuit. When an opening command is transmitted from the control unit 506, the first opening and closing execution unit 508 may operate to open the water discharge port 208. When a closing command is transmitted from the control unit 506, the first opening and closing execution unit 508 may operate to close the water discharge port 208.

Similarly, the second opening and closing execution unit 510 may have multiple components, e.g., including a solenoid valve and a driving circuit. When an opening command is transmitted from the control unit 506, the second opening and closing execution unit 510 may operate to open the ice discharge port 204. When a closing command is transmitted from the control unit 506, the second opening and closing execution unit 510 may operate to close the ice discharge port 204.

Hereinafter, an exemplary process for controlling operation of the dispenser will be described in detail with reference to the dispenser structure and the apparatus of operation control for refrigeration equipment having the configuration as described above in accordance with an embodiment of the present invention.

Figure 6:
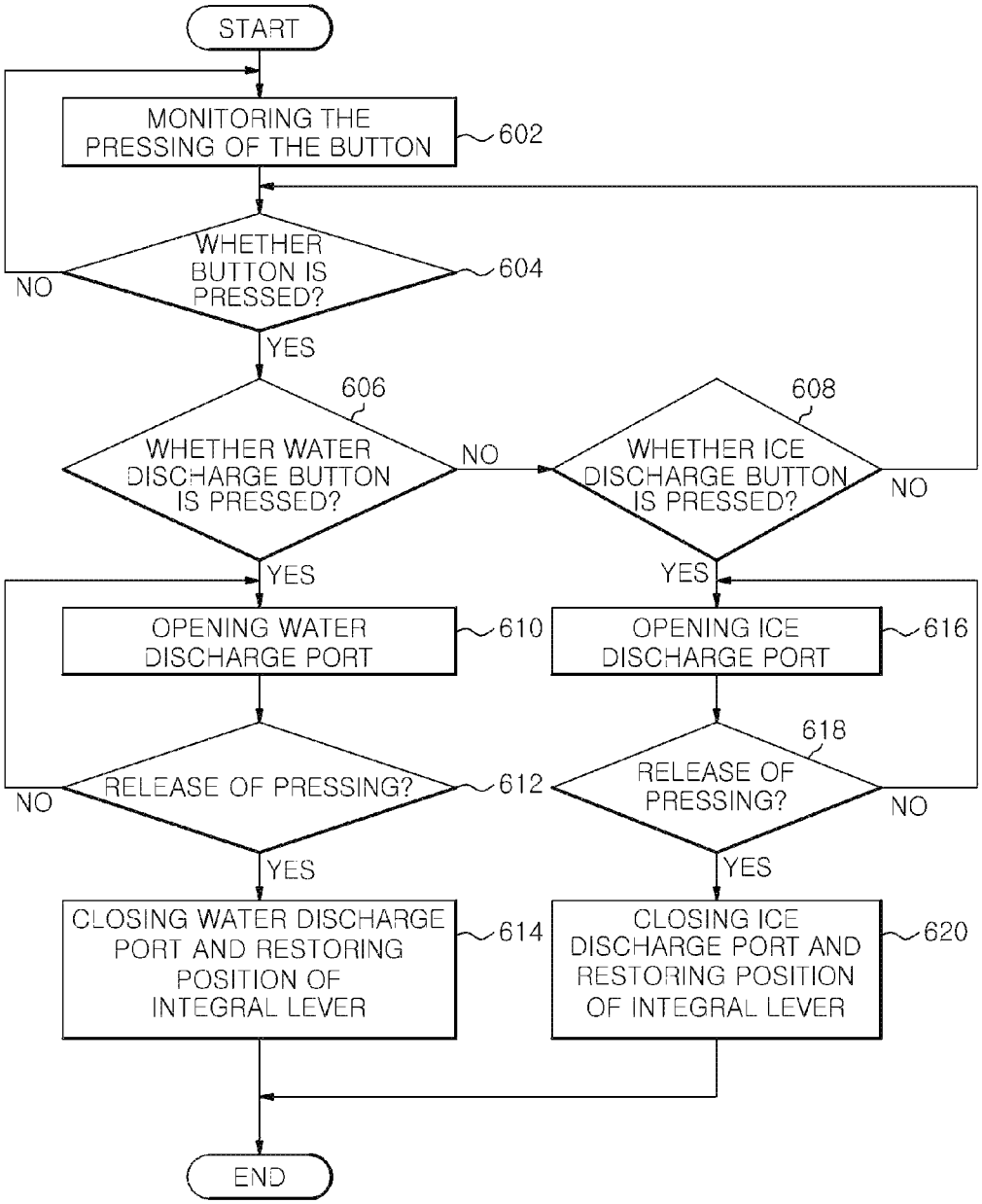
FIG. 6 is a flow chart showing an exemplary process for controlling operation of a dispenser on the refrigeration equipment in accordance with an embodiment of the present disclosure.

FIG. 6 is a flow chart showing an exemplary process for controlling operation of a dispenser on a refrigeration equipment in accordance with the invention.

Referring to FIG. 6, at 602, the control unit 506 monitors whether the water discharge button 210*a* or the ice discharge button 210*b* is pressed. The water discharge button 210*a* corresponds to one end of an integral lever 210 coupled pivotally to the ice guide 206 assembled at the tip of an ice discharge port 204, as described in greater detail above. The ice discharge button 210*b* is on the other end of the integral lever 210.

To this end, when the water discharge button 210*a* is pressed, the first switch 212 generates a sensing signal of pressing to open the water discharge port 208 and transmits the sensing signal to the control unit 506. When the pressing of the ice discharge button 201*b* is sensed, the second switch 216 generates a sensing signal of pressing to open the ice discharge port 204 and transmits the sensing signal to the control unit 506.

In other words, when the discharge button is pressed at 604, the control unit 506 determines whether the water discharge button 210*a* or the ice discharge button 210*b* is pressed, at 606 and 608.

If it is determine the water discharge button 210*a* is pressed, the control unit 506 generates an opening command for discharging water and transmits the command to the first opening and closing execution unit 508. Consequently, the water discharge port 208 is opened by the first opening and closing execution unit 508. As a result, water is discharged from the refrigerator to the outside, at 610.

At 612, the control unit 506 determines whether a sensing signal of releasing of pressing of the water discharge button 210*a* is input from the first switch 212. When the sensing signal of releasing is received, the control unit 506 generates a closing command to stop discharging water and transmits the command to the first opening and closing execution unit 508. As a result, the water discharge port 208 is closed by the first opening and closing execution unit 508. As a result, water dispensing is stopped. At the same time the position of the integral lever 210 is restored automatically by the first restoring member 214 at 614. In other words, the water discharge port 208 is opened to allow water to be discharged to the outside only when the water discharge button 210*a* is pressed.

On the other hand, if it is determined at 608 that the pressing is for the ice discharge button 210*b*, the control unit 506 generates an opening command for discharging ice and transmits the command to the second opening and closing execution unit 510. As a result, the ice discharge port 204 is opened by the second opening and closing execution unit 510. As a result, ice is discharged to the outside of the refrigerator at 616.

At 618, the control unit 506 determines whether a sensing signal of releasing of the ice discharge button 210*b* is input from the second switch 216. If yes, the control unit 506 generates a closing command to stop discharging ice and transmits the command to the second opening and closing execution unit 510. As a result, the ice discharge port 204 is closed by the second opening and closing execution unit 510. Thereby, ice discharging is stopped and the position of the integral lever 210 is restored automatically by the second restoring member 218 at operation 620. In other words, the ice discharge port 204 is opened to allow ice to be discharged to the outside only when the ice discharge button 210*b* is pressed.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A dispenser assembly on a refrigeration equipment, the dispenser assembly comprising:

an ice discharge port configured to discharge ice supplied from the refrigerator equipment;

an ice guide configured to direct ice from the ice discharge port to an outside of the refrigerator equipment;

a water discharge port configured to discharge water supplied from the refrigerator equipment;

a first switch configured to generate a first sensing signal for opening the water discharge port when pushed;

a second switch configured to generate a second sensing signal for opening the ice discharge port when pushed;

a shaft; and a lever coupled pivotally to the ice guide by the shaft, the lever having a through hole for ice, a first end configured to push the first switch when the lever is pivoted in a first direction, and a second end configured to push the second switch when the lever is pivoted in a second direction different from the first direction;

wherein the shaft and the through hole are disposed between the first end of the lever and the second end of the lever.

2. The dispenser assembly of claim 1, wherein the lever is coupled to a lower end of the ice guide via the shaft, and wherein the lever is configured to pivot vertically about the shaft.

3. The dispenser assembly of claim 1 further comprising:

a control unit configured to control the water discharge port according to the first sensing signal and the ice discharge port according to the second sensing signal.

4. The dispenser assembly of claim 3 further comprising:

a first restoring member configured to restore automatically a position of the lever to a relaxed state in response to the external pressure exerted on the first end being released; and a second restoring member configured to restore automatically the position of the lever to the relaxed state in response to the external pressure exerted on the second end being released.

5. The dispenser assembly of claim 4, wherein each of the first and second restoring members comprises a spring structure.

6. A method for controlling operation of the dispenser assembly of claim 1, the method comprising:

detecting an external pressure applied on the first switch and the second switch, wherein the first switch corresponds to the first end of the lever; and wherein the second switch corresponds to the second end of the lever, and wherein the lever is coupled pivotally to an ice guide assembled at an end of the ice discharge port;

discharging water by opening the water discharge port in response to detection of the external pressure applied on the first switch;

discharging ice by opening the ice discharge port in response to detection of the external pressure applied on the second switch; and restoring automatically a position of the lever to a relaxed state in response to detection of a release of the external pressure applied on the first switch and the second switch.

7. The method of claim 6 further comprising stopping discharging the water in response to the detection of the release of the external pressure applied on the first switch.

8. The method of claim 6 further comprising stopping discharging the ice in response to the detection of the release of the external pressure applied on the second switch.

* * * * *